US011529546B2

(12) United States Patent
Yan

(10) Patent No.: US 11,529,546 B2
(45) Date of Patent: Dec. 20, 2022

(54) TREADMILL WITH CONTINUOUS PULL FORCE ON USER

(71) Applicant: Hui Yan, Huntington Beach, CA (US)

(72) Inventor: Hui Yan, Huntington Beach, CA (US)

( * ) Notice: Subject to any disclaimer, the term of this patent is extended or adjusted under 35 U.S.C. 154(b) by 36 days.

(21) Appl. No.: 16/647,724

(22) PCT Filed: Aug. 13, 2018

(86) PCT No.: PCT/US2018/046406
§ 371 (c)(1),
(2) Date: Mar. 16, 2020

(87) PCT Pub. No.: WO2019/070344
PCT Pub. Date: Apr. 11, 2019

(65) Prior Publication Data

US 2020/0222749 A1 Jul. 16, 2020

Related U.S. Application Data

(60) Provisional application No. 62/567,078, filed on Oct. 2, 2017.

(51) Int. Cl.

| | |
|---|---|
| ***A63B 22/02*** | (2006.01) |
| ***A63B 22/00*** | (2006.01) |
| ***A63B 21/055*** | (2006.01) |
| ***A63B 21/00*** | (2006.01) |
| ***A63B 69/00*** | (2006.01) |

(52) U.S. Cl.
CPC ..... *A63B 22/02* (2013.01); *A63B 21/0557* (2013.01); *A63B 21/154* (2013.01); *A63B 22/0025* (2015.10); *A63B 69/0057* (2013.01); *A63B 2022/0038* (2013.01)

(58) Field of Classification Search
CPC ..... A63B 22/0025; A63B 21/154; A63B 2022/0038; A63B 69/0057; A63B 21/0552; A63B 21/02; A63B 21/028; A63B 21/04; A63B 21/0428; A63B 21/0442; A63B 21/05–0557; A63B 22/02–0292; A61H 1/02; A61H 3/00
See application file for complete search history.

(56) References Cited

U.S. PATENT DOCUMENTS

| | | | | | |
|---|---|---|---|---|---|
| 1,016,729 | A * | 2/1912 | Barrett | A63B 22/02 | 482/54 |
| 1,766,089 | A * | 6/1930 | Wood | A63B 22/02 | 482/54 |
| 2,017,128 | A * | 10/1935 | O'Neill, Jr. | A63B 22/02 | 482/54 |
| 4,625,962 | A * | 12/1986 | Street | A63B 21/015 | 482/116 |
| 5,919,119 | A * | 7/1999 | Bohmer | A63B 22/02 | 482/54 |
| 6,123,649 | A * | 9/2000 | Lee | A63B 21/153 | 482/51 |

(Continued)

*Primary Examiner* — Garrett K Atkinson
*Assistant Examiner* — Kathleen M Fisk
(74) *Attorney, Agent, or Firm* — Fish IP Law, LLP

(57) ABSTRACT

The present invention relates to a novel treadmill with elastic band aided system to drive the tread belt. The elastic band aided system includes at least one of the foot attachment, hand attachment, and waist attachment. This elastic (Continued)

band aided system can be used in manual treadmills and motorized treadmills.

9 Claims, 5 Drawing Sheets

(56) References Cited

U.S. PATENT DOCUMENTS 6,126,575 A * 10/2000 Wang ..... A63B 22/0257 482/51
6,575,876 B1 * 6/2003 Phelps-McMillon ..... A63B 22/0235 482/51
6,837,830 B2 * 1/2005 Eldridge ..... A63B 21/225 482/54
7,533,870 B2 * 5/2009 Camrass ..... B66D 3/046 254/402
7,998,040 B2 * 8/2011 Kram ..... A63B 21/4013 482/124
8,075,453 B1 * 12/2011 Wilkinson ..... A63B 21/153 482/51
9,433,819 B1 * 9/2016 Carducci ..... A63B 22/0214
9,914,012 B2 * 3/2018 Walter ..... A63B 21/4039
10,773,121 B2 * 9/2020 Del Monaco ..... A63B 22/0089
2002/0086779 A1 * 7/2002 Wilkinson ..... A63B 21/00069 482/118
2003/0004038 A1 * 1/2003 Wroclawsky ..... A63B 21/4009 482/54
2004/0087418 A1 * 5/2004 Eldridge ..... A63B 21/157 482/54
2005/0009669 A1 * 1/2005 Harris ..... A63B 21/4009 482/69
2007/0232463 A1 * 10/2007 Wu ..... A63B 22/0257 482/54
2011/0237399 A1 * 9/2011 Toback ..... A63B 21/0442 482/8
2012/0197168 A1 * 8/2012 Agrawal ..... A63B 23/047 602/19
2012/0295769 A1 * 11/2012 Pennington ..... A63B 21/4017 482/54
2013/0225371 A1 * 8/2013 Harrer ..... A63B 21/16 482/8
2017/0312582 A1 * 11/2017 Root, Jr. ..... A63B 21/4009
2020/0086163 A1 * 3/2020 Karys ..... A63B 21/0442

* cited by examiner

TREADMILL WITH CONTINUOUS PULL FORCE ON USER

CROSS-REFERENCE TO RELATED APPLICATIONS

This application claims the benefit of priority of U.S. Provision Patent Application No. 62/567,078, filed on Oct. 2, 2017, entitled "TREADMILL WITH CONSISTENT PULL FORCE ON USER'S FEET", which applications are hereby incorporated by reference in their entireties.

FIELD OF THE INVENTION

The present invention relates to treadmills used for walking and running exercise. More particularly, the invention relates to a new concept treadmill with consistent pull force on user. The present invention can be used on either motorized or manual treadmills.

BACKGROUND

Current treadmills can be divided into two categories: motorized and non-motorized treadmill (or called manual treadmill). For motorized treadmill, user needs to adjust treadmill's speed in order to walk/run the desired speed. User has to walk/run faster or increase the incline of tread base to gain more intensive exercise. For many users, increasing the speed or incline may hurt their knees.

As for the regular manual or non-motorized treadmill, because the frictional resistance between the tread belt and the foot board's upper surface needs to be overcome by user, it's difficult to reach the desired speed without increasing the incline of the tread base. In most case, increasing the incline of the tread base is the only option for higher intensity workout. This significantly limited the usage of the non-motorized treadmills.

How can we get higher intensity workout without high speed or high incline is the biggest challenge in the treadmill world. Adding a consistent force on user's body can significantly increase the efficiency of exercise on both motorized or manual treadmills.

BRIEF SUMMARY OF THE INVENTION

The present invention comprises a novel treadmill elastic resistance system generally consisting of at least one elastic band with one end connected to treadmill and the other end connected to the user's body (normally on user's feet, hands, or waist) with consistent pull force during walking/running exercise on the treadmill. In order to generate a comfortable resistance force, the elastic band needs to be stretch out without rolling up. Pulley needs to be used at the turning point of the elastic band.

BRIEF DESCRIPTION OF THE DRAWINGS

Four of the embodiments of the present invention are illustrated as an example and is not limited by the figures of accompanying drawing.

The FIG. 1 is a perspective view of the elastic band aided treadmill with foot attachments.

Figure 2:
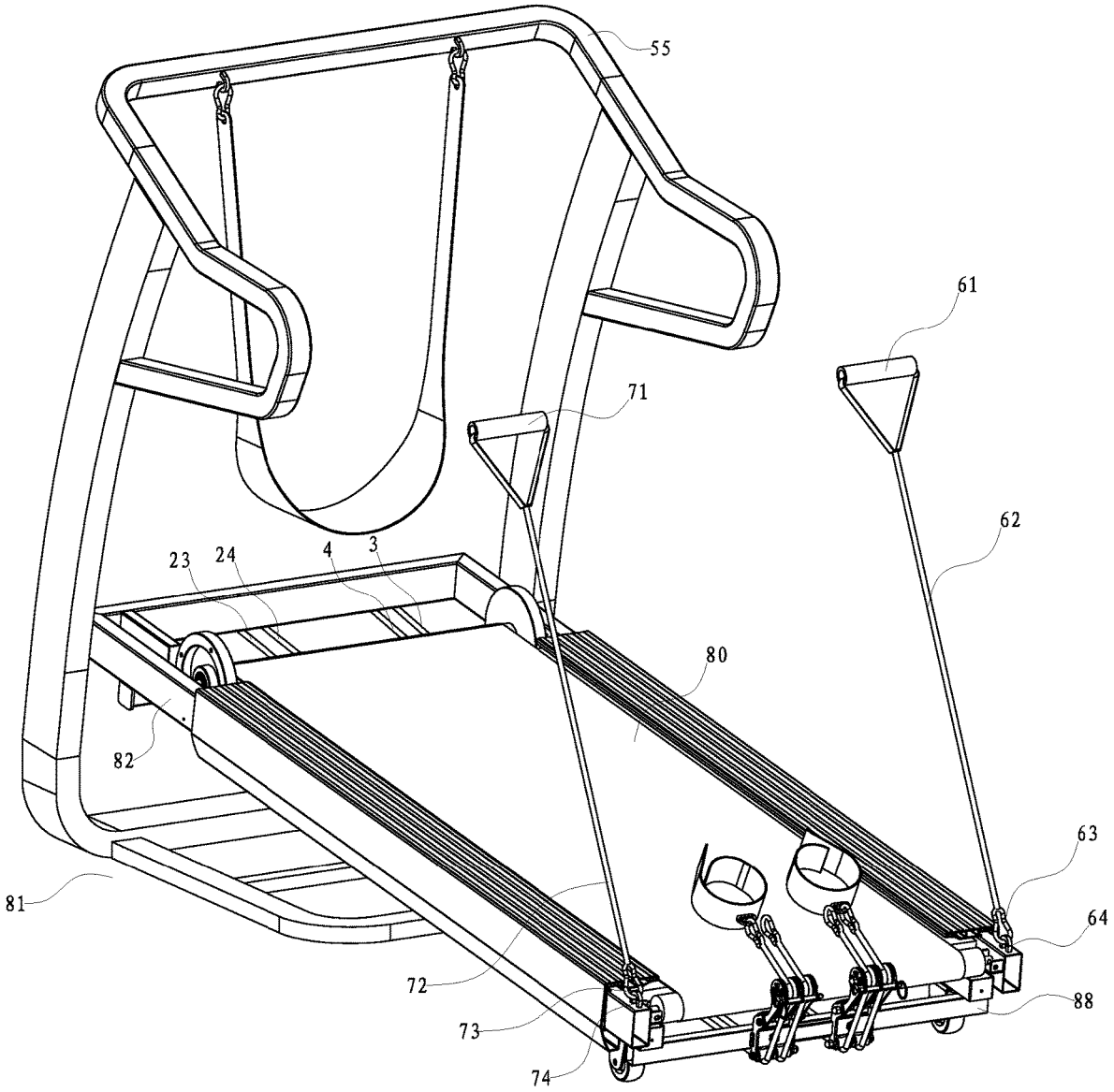

The FIG. 2 is a perspective view of the elastic band aided treadmill with foot attachments and simple hand bands.

Figure 3:
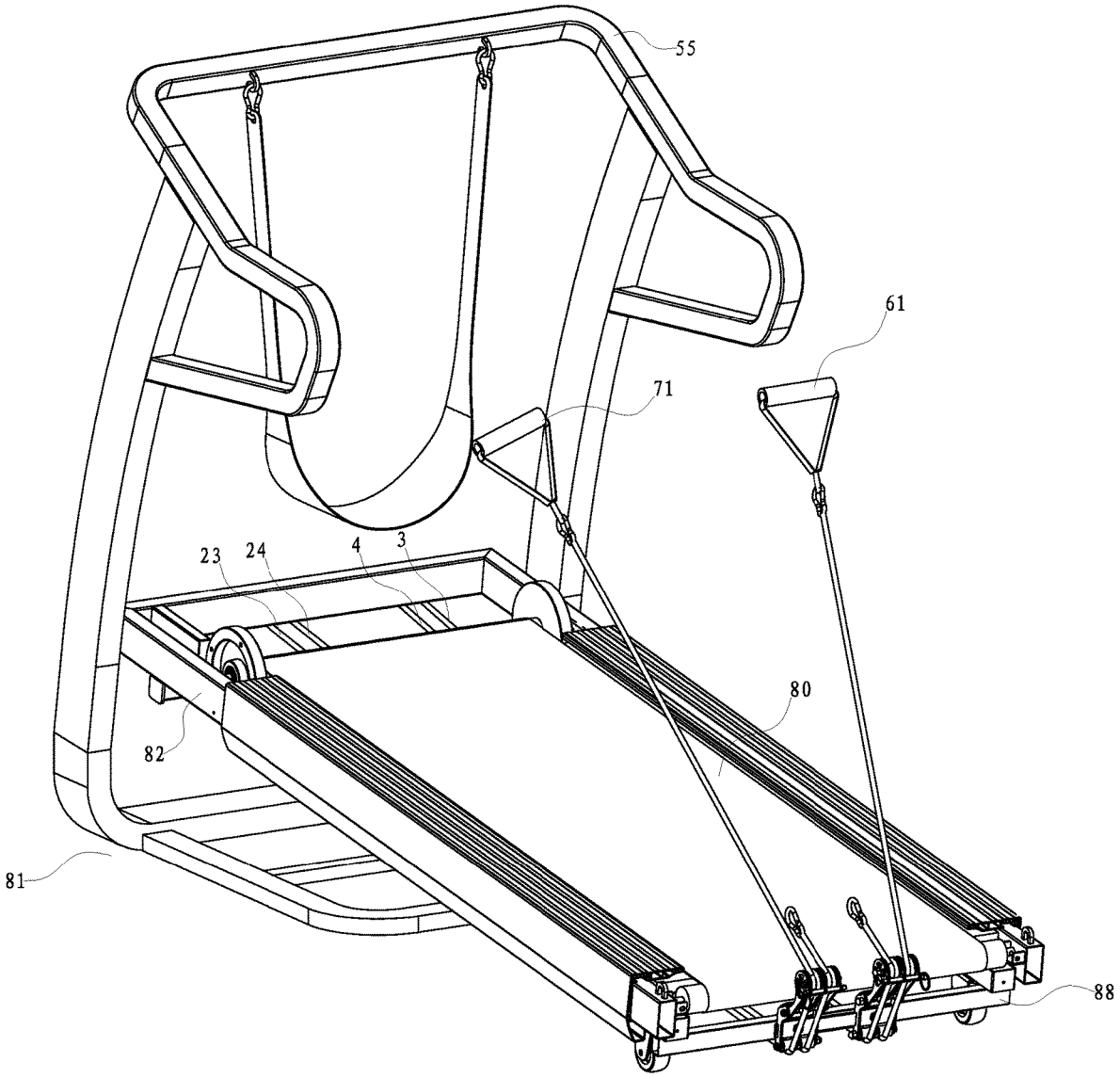

The FIG. 3 is a perspective view of the elastic band aided treadmill with hand attachments.

Figure 4:
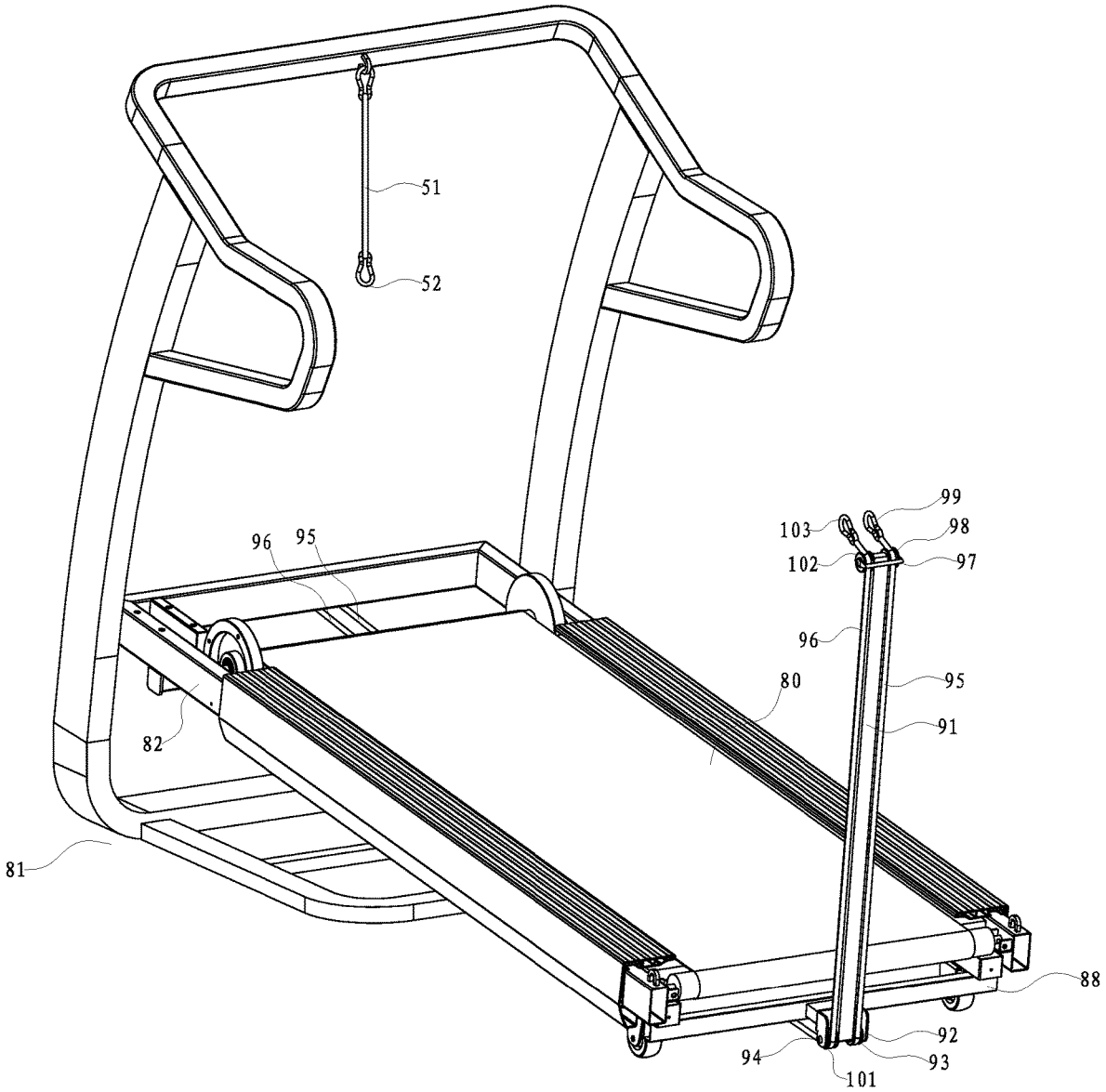

The FIG. 4 is a perspective view of the elastic band aided treadmill with waist attachments.

Figure 5:
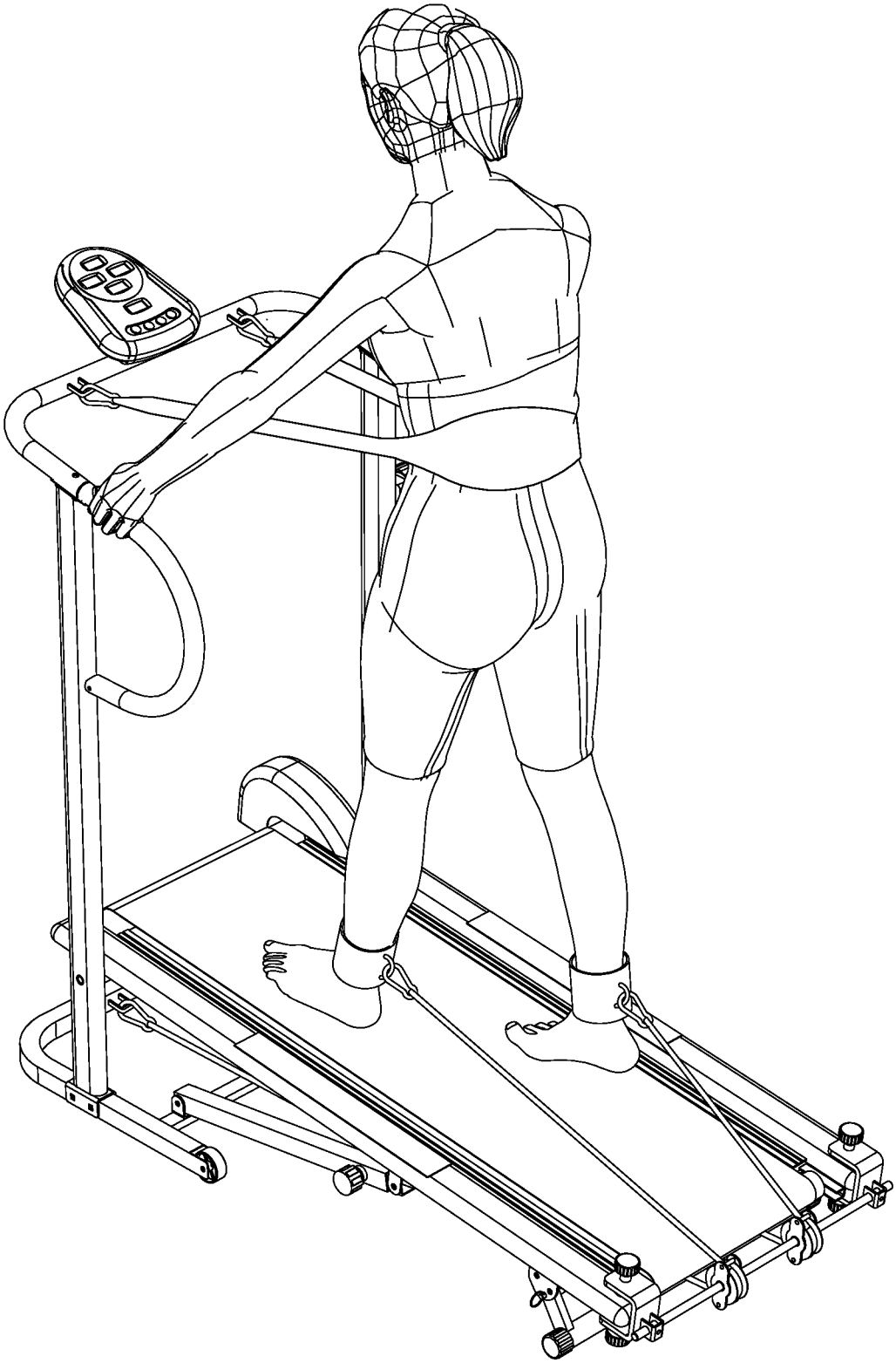

The FIG. 5 is a using illustration of the elastic band aided treadmill with foot attachments.

DETAILED DESCRIPTION OF THE INVENTION

The present disclosure is to be considered as an exemplification of the invention, and is not intended to limit the invention to the specific embodiments illustrated by the figures or descriptions below.

Figure 1:
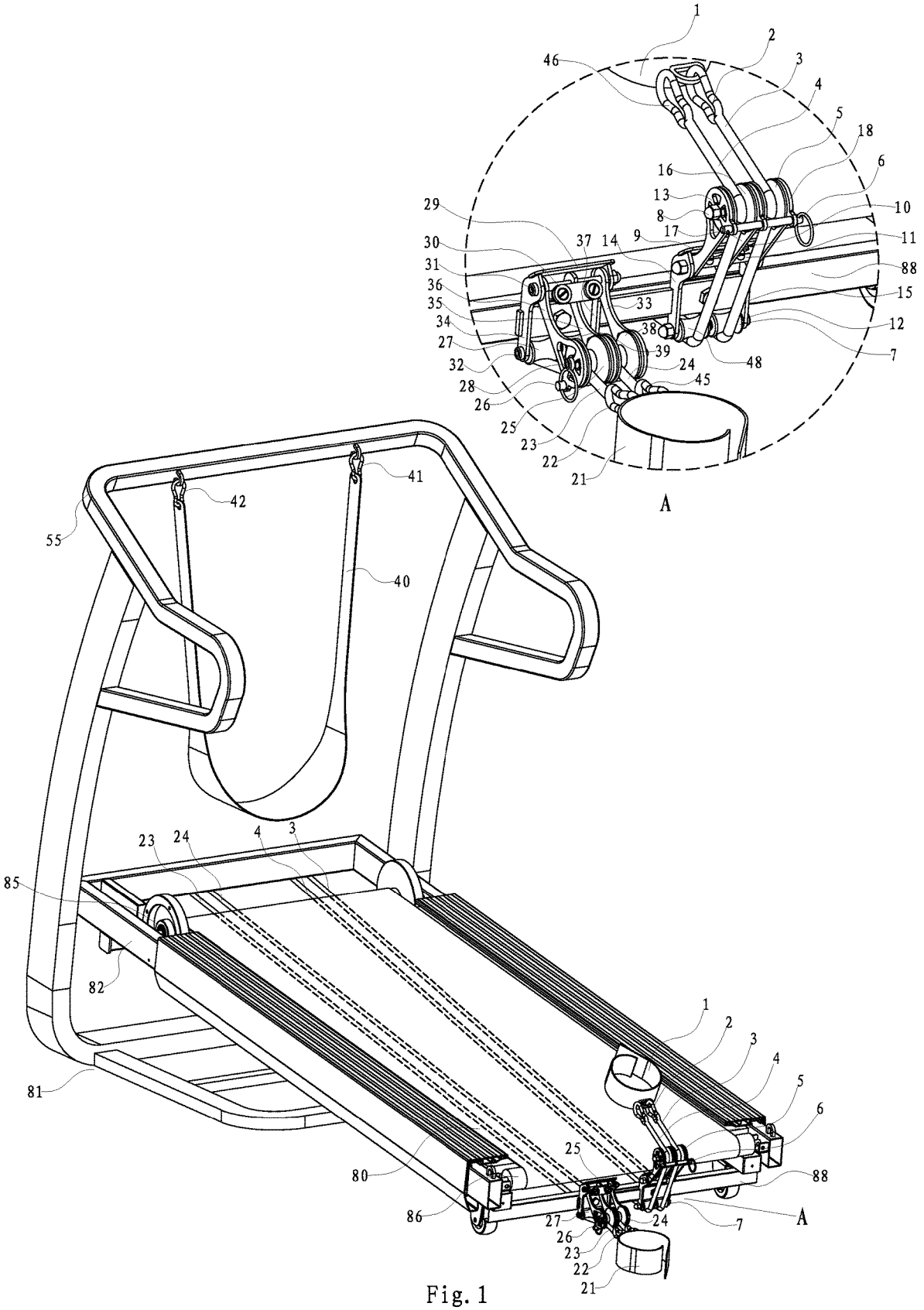

In FIG. 1, treadmill with basic structure such as base 81, footboard frame 82, front shaft 85, rear shaft 86, and endless tread belt 80. Each of the two groups of elastic bands 3, 4 and 23, 24 has one end been connected to the front of the footboard frame 82 and the other end connected to the user's foot. The right-side group of elastic bands 3 and 4 is for right foot, and each elastic bands 3 and 4 can be different tensile strength. User can attach elastic band 3 or 4 on the right foot for low and medium intensive exercise, or use both elastic bands 3 and 4 on the right foot for high intensive exercise. The left-side group of elastic bands 23 and 24 is for left foot, and each elastic bands 23 and 24 can be different tensile strength. User can attach elastic band 23 or 24 on the left foot for low and medium intensive exercises, or use both elastic bands 23 and 24 on the left foot for high intensive exercise. Magnetic embedded pivotal pulley frame is used for each group of elastic bands. The pulleys 5 and 7 are used for elastic band 3 to change its direction, two similar pulleys 16 and 8 are used for elastic band 4. The pulleys 25 and 27 are used for elastic band 23 to change its direction, two similar pulleys 38 and 39 are used for elastic band 24. To obtain practical continuous pulling force, relatively long pre-stretched elastic bands are used. Therefore, the starting and ending pulling forces for each step will not be too much difference. Normally, the ending pulling force will be less than three times of the starting pulling force. Pulley wheels are key element for using relatively long elastic band, which is at least longer than one normal running stride.

In the enlargement part A of FIG. 1, steel panel 29 is fixed on brackets 34 and 37. Both brackets 34 and 37 are attached on the lower bar 88 that attached on the footboard frame 82. The left magnetic embedded pivotal pulley frame comprises brackets 34 and 37, pulleys 27 and 39 on shaft 32, and the pivotal frame on shaft 31. This pivotal frame comprises brackets 33, 35, and 36, pulleys 25 and 38 on shaft 28, lock pin 26, and magnetic button 30. Pushing the left magnetic embedded pivotal pulley frame up till the magnetic button 30 touches the steel panel 29 will lock the left magnetic embedded pivotal pulley frame at an upraised position and ready for user to pull the elastic bands 23 and 24. During the using, if user's foot stepping on the magnetic embedded pivotal pulley frame, the magnetic button will be forced to move away from the steel panel 29 and the frame will flip over to prevent injuring user. As for the right side, steel panel 9 is fixed on brackets 14 and 15. Both brackets 14 and 15 are attached on the lower bar 88 that attached on the footboard frame 82. The right magnetic embedded pivotal pulley frame comprises brackets 14 and 15, pulleys 7, and 48 on shaft 12, and the pivotal frame on shaft 11. This pivotal frame comprises brackets 13, 17, and 18, pulleys 5 and 16 on shaft 8, lock pin 6, and magnetic button 10. Pushing the left magnetic embedded pivotal pulley frame up till the magnetic button 10 touch the steel panel 9 will lock the right magnetic embedded pivotal pulley frame at an upraised position and ready for user to pull the elastic bands 3 and 4.

One end of the right elastic band 3 is connected to the user's right foot ankle strap 1 via carabiner hook clip 2. One end of the other right elastic band 4 is also connected to the user's right foot ankle strap 1 via carabiner hook clip 46. The ankle straps 1 and 21 used here are regular fitness ankle strap cuffs with D ring. One end of the left elastic band 23 is connected to the user's left foot ankle strap 21 via carabiner hook clip 22. One end of the other left elastic band 24 is connected to the user's left foot ankle strap 21 via carabiner hook clip 45. Lock pin 6 and 26 can be pulled out during changing elastic band.

After adding the resistance bands on user's feet, the user's upper body to lean backwards during the exercise. In order to balance user's body, an upper body belt 40 is used to pull user's body forward at the waist area. Each end of the upper body belt 40 is linked to the treadmill's upper front frame 55 by carabiner hook clips 41 and 42, the middle part of the upper body belt 40 is behind user's body at the waist area. Also, one end of the belt 51 can be connected to the front of the user's waist belt via carabiner hook clip 52 and the other end connected to the front frame (see FIG. 5).

As for the non-motorized treadmills, to walk/run more intensively and comfortably, user needs some additional force to pull tread belt backwards during exercise. The best way to achieve this is to add an elastic band resistance force on each of user's foot. When user moves his/her foot forwards, he/she pulls the elastic band and store the energy inside the elastic band. The elongated elastic band, with the stored energy, will pull user's foot backwards together with the tread belt during exercise. This elastic band system can also be used on motorized treadmill to increase workout intensity. Therefore, users can get high intensive exercise at lower speed.

In FIG. 2, two elastic bands with handle are on both side of footboard frame. On right-side, handle 61 with elastic band 62 is connected to the footboard frame 82 via a screw 64 and carabiner hook clip 63. On left-side, handle 71 with elastic band 72 is connected to the footboard frame 82 via a screw 74 and carabiner hook clip 73. User can hold handles 61 and 71 with right hand and left hand respectively during running.

In FIG. 3, foot ankle straps 1 and 21 are replace by handles 61 and 71. User can hold handles 61 and 71 with right hand and left hand respectively during running.

In FIG. 4, high raised pole 91 allows user to attach the elastic bands 95 and 96 to user's lower back. Pulleys 93 and 101 are on shaft 94. Shaft 94 is on steel support 92. Lower end of pole 91 with magnetic button is rotatably connected to shaft 94. Pole 91 can rotate backwards to the floor when pushed backwards to separate the magnetic button away from the support 92. Elastic band 95 passed pulley 93 and pulley 98. Locker 97 prevent carabiner hook clips 99 and 103 be pulled off the pulleys 98 and 102. Belt 51 hold user's waist belt with carabiner hook clip 52.

What is claimed is:

1. A treadmill having a frame and a tread belt mounted within the frame, the treadmill operable by a user, and comprising:

an elastic band configured to be coupled to a leg of the user;

a pivoting pulley frame comprising (i) a first frame bracket mounted on a rear end of the frame, (ii) a second frame bracket rotatably coupled to the first frame bracket, (iii) a first pulley disposed on the first frame bracket, and (iv) a second pulley disposed on the second frame bracket;

the elastic band extending to a rear of the treadmill, and then over the first and second pulleys and under the tread belt;

wherein the second frame bracket is configured to transition from an upraised position to a lowered position when pushed by the user's foot;

wherein a magnet is coupled to the second frame bracket, and wherein the magnet is configured to magnetically couple a panel fixed on the first frame bracket when the second frame bracket is in the upraised position; and wherein the treadmill has no motor configured to move the tread belt.

2. The treadmill of claim 1, wherein the first pulley is disposed on a bottom of the first frame bracket and the second pulley is disposed on an end of the second frame bracket.

3. The treadmill of claim 2, wherein the second pulley is lifted above the rear end of the frame when the second frame bracket transitions to the upraised position.

4. The treadmill of claim 1, wherein the elastic band is wrapped about the second pulley for less than 360 degrees.

5. The treadmill of claim 1, wherein the elastic band has a length longer than a front to back length of the tread belt.

6. The treadmill of claim 1, further comprising an upper body belt coupled to a cross bar of the frame.

7. The treadmill of claim 1, wherein the elastic band is configured to be coupled to a left ankle of the user, and a second elastic band is configured to be coupled to a right ankle of the user, and the second elastic band extends to the rear of the treadmill, and then under the tread belt.

8. The treadmill of claim 1, wherein the elastic band is pre-stretched.

9. The treadmill of claim 1, wherein a front of the tread belt is elevated relative to a rear of the tread belt.

* * * * *